US010981743B2

(12) United States Patent
Okada et al.

(10) Patent No.: US 10,981,743 B2
(45) Date of Patent: Apr. 20, 2021

(54) SHEET STACKING DEVICE, POST PROCESSING APPARATUS AND IMAGE FORMING APPARATUS

(71) Applicant: KYOCERA Document Solutions Inc., Osaka (JP)

(72) Inventors: Rina Okada, Osaka (JP); Yasunori Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/898,406

(22) Filed: Jun. 10, 2020

(65) Prior Publication Data

US 2020/0391971 A1 Dec. 17, 2020

(30) Foreign Application Priority Data

Jun. 17, 2019 (JP) ..... JP2019-112215

(51) Int. Cl.
*B65H 31/10* (2006.01)
*B65H 37/00* (2006.01)

(52) U.S. Cl.
CPC ..... *B65H 31/10* (2013.01); *B65H 37/00* (2013.01); *B65H 2301/4212* (2013.01); *B65H 2801/27* (2013.01)

(58) Field of Classification Search
CPC ..... B65H 31/10; B65H 2301/4212; B65H 2801/27
USPC ..... 270/58.13, 58.28
See application file for complete search history.

(56) References Cited

U.S. PATENT DOCUMENTS 6,145,826 A * 11/2000 Kawata ..... B65H 31/10 270/58.13
6,505,829 B2 * 1/2003 Kawata ..... B65H 31/00 271/208
7,690,637 B2 * 4/2010 Yamamoto ..... G03G 15/6538 270/58.13
8,632,065 B2 * 1/2014 Nozawa ..... B65H 31/02 270/58.28
8,882,105 B2 11/2014 Iwata

FOREIGN PATENT DOCUMENTS

JP 2013230894 A 11/2013

* cited by examiner

*Primary Examiner* — Leslie A Nicholson, III
(74) *Attorney, Agent, or Firm* — Studebaker & Brackett PC

(57) ABSTRACT

A sheet stacking device includes a housing, a discharge tray, a lifting mechanism, a first upper surface detection part, a second upper surface detection part and a control part. The housing has a discharge port. On the discharge tray, the sheet discharged from the discharge port in a predetermined discharge direction is stacked. The lifting mechanism supports the discharge tray. The first upper surface detection part detects a first detected surface of the sheet on the discharge tray. The second upper surface detection part detects a second detected surface of the sheet on the discharge tray on a downstream side of the first detected surface in the sheet discharge direction. The control part controls the lifting mechanism based on a detection result of the first upper surface detection part and a detection result of the second upper surface detection part, and adjusts the discharge tray at a predetermined height.

9 Claims, 10 Drawing Sheets

SHEET STACKING DEVICE, POST PROCESSING APPARATUS AND IMAGE FORMING APPARATUS

INCORPORATION BY REFERENCE

This application is based on and claims the benefit of priority from Japanese Patent application No. 2019-112215 filed on Jun. 17, 2019, which is incorporated by reference in its entirety.

TECHNICAL FIELD

The present disclosure relates to a sheet stacking device, a post processing apparatus and an image forming apparatus.

BACKGROUND

An image forming apparatus and a post processing apparatus are provided with a sheet stacking device which stacks a sheet discharged through a discharge port on a discharge tray. As the type of sheet stacking device, it is known that an upper surface of the uppermost sheet is kept at a constant height regardless of a number of the sheets on the discharge tray. The sheet stacking device has an upper surface detection part which is disposed near the discharge port and detects the upper surface of the sheet. The discharge tray is lifted or lowered every time when the sheet is discharged through the discharge port on the discharge tray, and the height of the discharge tray is adjusted such that the uppermost sheet is detected by the upper surface detection part at a constant height.

SUMMARY OF THE INVENTION

In accordance with an aspect of the present disclosure, a sheet stacking device includes a housing, a discharge tray, a lifting mechanism, a first upper surface detection part, a second upper surface detection part and a control part. The housing has a discharge port from which a sheet is discharge. On the discharge tray, the sheet discharged from the discharge port in a predetermined discharge direction is stacked. The lifting mechanism is provided in the housing and supports the discharge tray so as to be lifted and lowered. The first upper surface detection part detects a first detected surface of an upper surface of the sheet on the discharge tray on an upstream side in the sheet discharge direction. The second upper surface detection part detects a second detected surface of the upper surface of the sheet on the discharge tray on a downstream side of the first detected surface in the sheet discharge direction. The control part controls the lifting mechanism based on a detection result of the first upper surface detection part and a detection result of the second upper surface detection part and to adjust the discharge tray at a predetermined height.

In accordance with an aspect of the present disclosure, a post processing apparatus includes the sheet stacking device and a post processing part performing a post processing on the sheets and discharging the sheets to the sheet stacking device.

In accordance with an aspect of the disclosure, an image forming apparatus includes an image forming part forming an image on the sheet; and the post processing apparatus.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
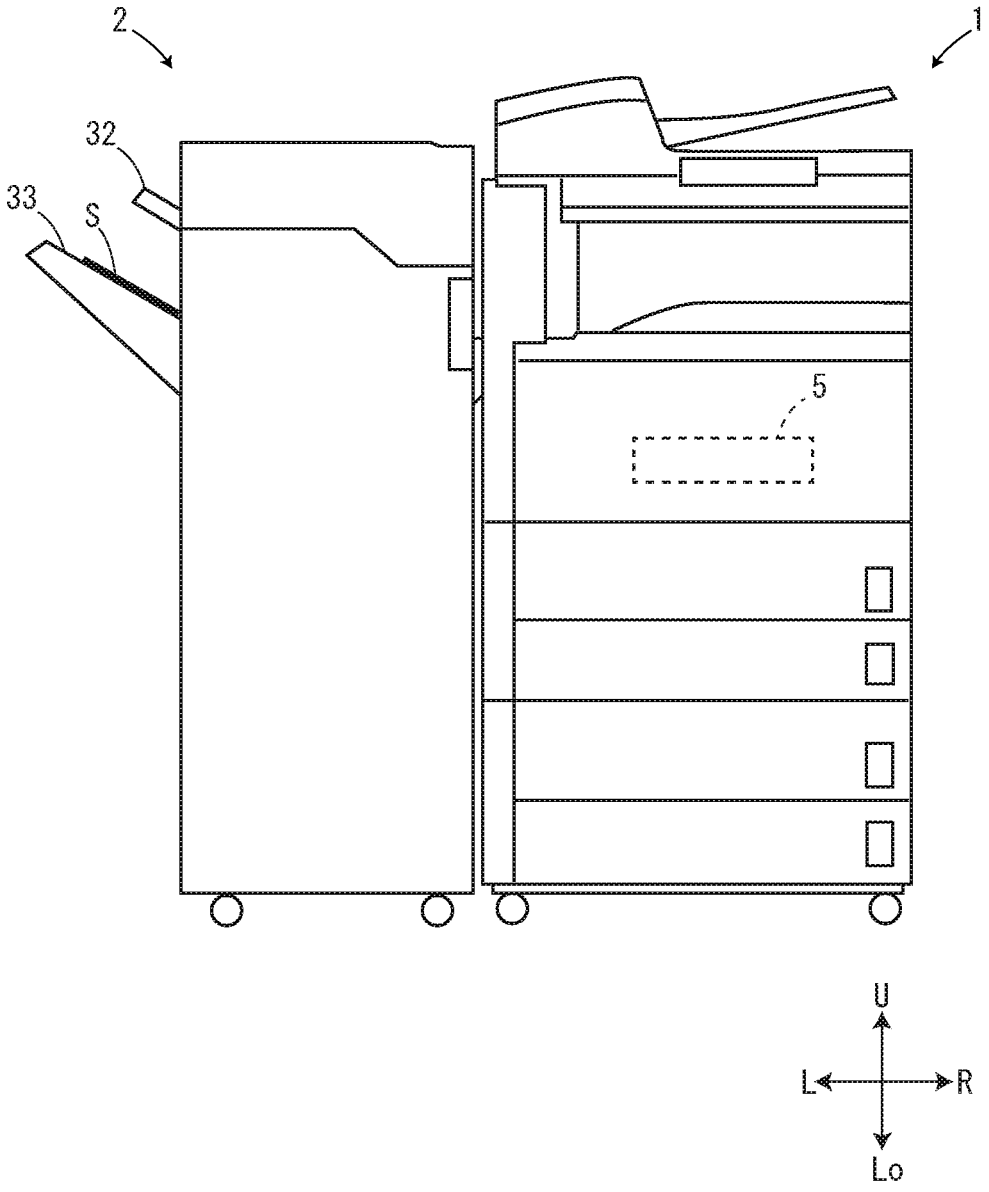
FIG. 1 is a view schematically showing a post processing apparatus and a multifunctional peripheral according to the present embodiment.
Figure 2:
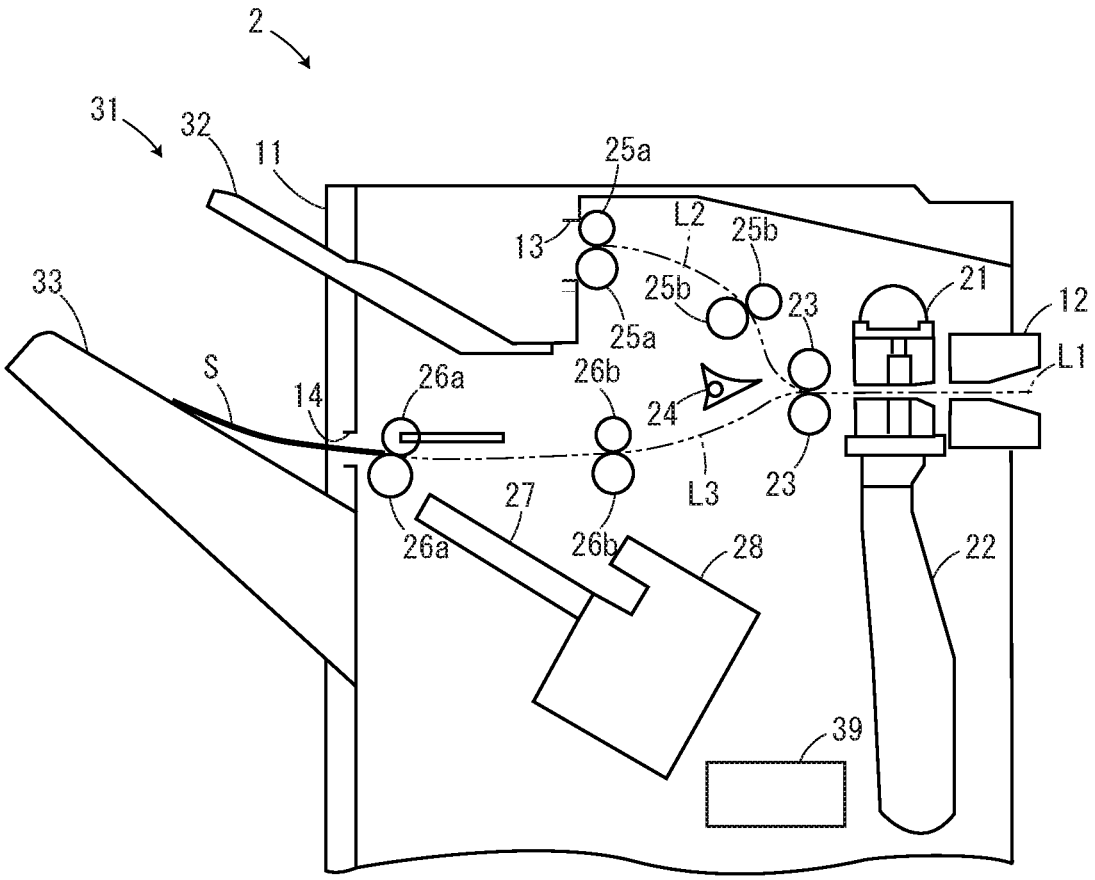
FIG. 2 is a sectional view schematically showing the post processing apparatus according to the present embodiment.

Hereinafter, with reference to the attached drawings, a post processing apparatus including a sheet stacking device according to the present embodiment will be described. FIG. 1 is a view schematically showing the post processing apparatus and a multifunctional peripheral. FIG. 2 is a sectional view schematically showing the post processing apparatus. FIG. 3 is a view showing an example of a stacking operation of a sheet stacking operation in a comparative example. For convenience of description, a front side of a paper on which FIG. 1 is drawn is defined as a front side of the post processing device, and the left-and-right direction is based on a direction in which the post processing device is shown from the front side. Arrows L, R, U and Lo marked in each figure respectively show the left side, the right side, the upper side and the lower side of the post processing device. In the following description, an upstream side and a downstream side respectively show an upstream side and a downstream side in a sheet conveyance direction.

As shown in FIG. 1, the post processing apparatus 2 is adjacently connected to the multifunctional peripheral 1 as an image forming apparatus, and a printed sheet S is conveyed from the multifunctional peripheral 1 to the post processing apparatus 2. The multifunctional peripheral 1 includes an image forming part 5 which forms an image on the sheet S. The post processing apparatus 2 performs a post processing, such as punching and binding, on the printed sheet S carried in from the multifunctional peripheral 1 and then discharges the post processed sheet S on an upper discharge tray 32 or a lower discharge tray (a discharge tray) 33. Here, although the post processing apparatus 2 performs the post processing on the sheet S carried in from the multifunctional peripheral 1, it may perform the post processing on the sheet S set on a carrying-in tray (not shown) of the post processing apparatus 2 by a user.

As shown in FIG. 2, the post processing apparatus 2 includes a box-shaped housing 11 in which various devices are stored. On the right side surface of the housing 11, a carrying-in port 12 in which the sheet S is carried from the multifunctional peripheral 1 is formed, and on the left side of the housing 11, a sheet stacking device 31 which stacks the sheet S on the upper discharge tray 32 and the lower discharge tray 33 is provided. In the housing 11, a conveyance path L1 is formed by a plurality of rollers, a branching member and the others, and the sheet S is conveyed along the conveyance path L1 from the carrying-in port 12 to the upper discharge port 13 of the upper discharge tray 32 and the lower discharge port 14 of the lower discharge tray 33. The conveyance path L1 is branched into an upper conveyance path L2 and a lower conveyance path L3 on the downstream side.

On the upstream side of the conveyance path L1, a punching device (a post processing part) 21 which punches holes in the sheet S carried in the carrying-in port 12 is provided. The punching device 21 punches holes in the side end portion of the sheet S along the sheet conveyance direction. Below the punching device 21, a collection container 22 is provided so as to collect punched chips generated by the punching of the sheet S. When the punching processing is not performed on the sheet S, the punching device 21 is not driven during the conveyance of the sheet S, and the sheet S is passed along the conveyance path L1 formed in the punching device 21.

On the downstream side of the punching device 21 on the conveyance path L1, a pair of resist rollers 23 is provided, and on the downstream side of the pair of resist rollers 23, the branching member 24 is provided, which guides the sheet S from the conveyance path L1 to the conveyance path L2 or the conveyance path L3. When the branching member 24 is driven by a motor or the like, the conveyance destination of the sheet S is switched between the upper conveyance path L2 and the lower conveyance path L3. On the upper conveyance path L2, a plurality of discharge rollers 25*a* and 25*b* which discharge the sheet S through the upper discharge port 13 on the upper discharge tray 32 is provided, and on the lower conveyance path L3, a plurality of discharge rollers (a discharge part) 26*a* and 26*b* which discharge the sheet S through the lower discharge port 14 on the lower discharge tray 33 is provided. The discharge rollers 26*a* near the lower discharge port 14 are capable of being separated away and coming into contact with each other.

Below the discharge rollers 26*a* and 26*b*, a processing tray 27 inclined downward from a side of the lower discharge port 14 to the right side is provided. The carrying-in processing and the discharge processing of the sheet S to and from the processing tray 27 are performed by the conveyance rollers 26*a* being separated away and coming into contact with each other. The processing tray 27 includes a stapler (the post processing part) 28 which staples the sheets S stacked on the processing tray 27. The stapler 28 binds the upstream side end portions of the sheets S stacked on the processing tray 27 to form a sheet bundle. When the binding processing is not performed on the sheets S, the sheet S is discharged through the lower discharge port 14 by the discharge rollers 26*a* and 26*b* without being stacked on the processing tray 27.

The post processing apparatus 2 includes a control part 39 which controls each part totally. The control part 39 may be configured by software using a processer or by a logic circuit (hardware) formed in an integrated circuit or the like. When the processer is used, the processer reads and executes a program stored in a memory to perform various processing. As the processer, for example, a central processing unit (CPU) is used. The memory is constituted by one or a plurality of recording mediums such as a read only memory (ROM) and a random access memory (RAM) depending on its use.

When the sheet S is carried in the post processing apparatus 2 through the carrying-in port 12 from multifunctional peripheral 1, the punching device 21 punches holes in the sheet S. After passing the punching device 21, the sheet S is guided by the branching member 24 to the upper conveyance path L2 or the lower conveyance path L3. When guided to the upper conveyance path L2 by the branching member 24, the sheet S is conveyed to the upper discharge port 13 by the discharge rollers 25*a* and 25*b*. Then, the sheet S is discharged by the discharge rollers 25*a* and 25*b* through the upper discharge port 13 and then stacked on the upper discharge tray 32.

On the other hand, when guided to the lower conveyance path L3 by the branching member 24, the sheet S is conveyed to the lower discharge port 14 by the discharge rollers 26*a* and 26*b*. When the sheet S is stacked on the processing tray 27, the discharge rollers 26*a* near the lower discharge port 14 are separated away and the sheet S is stacked on a placement surface of the processing tray 27 without being discharged through the lower discharge port 14. When a predetermined number of the sheets S is stacked on the processing tray 27, the sheets S are stapled by the stapler 28.

When the sheets S are discharged from the processing tray 27, the discharge rollers 26*a* near the lower discharge port 14 are closer to each other and nips the sheets S. The sheets S nipped by the discharge rollers 26*a* are discharged through the lower discharge port 14 and then stacked on the lower discharge tray 33. When the staple processing is not performed on the sheet S by the stapler 28, the sheet S is discharged through the lower discharge port 14 on the lower discharge tray 33 without being stacked on the processing tray 27.

In the sheet stacking device 31, a height of the uppermost sheet S on the lower discharge tray 33 is preferably kept at a constant height in order to improve aligning performance of the sheets S on the lower discharge tray 33. For example, the lower discharge tray 33 is slightly lowered every predetermined time or every predetermined number of the sheets, and the lower discharge tray 33 is adjusted such that the upper surface of the uppermost sheet S is kept at a constant height. In this case, there is a configuration that an upper surface detection part to detect the upper surface of the uppermost sheet S is provided near the lower discharge port 14 of the lower discharge tray 33 and a height of the lower discharge tray 33 is adjusted such that the upper surface of the uppermost sheet S is detected by the upper surface detection part.

Figure 3A:
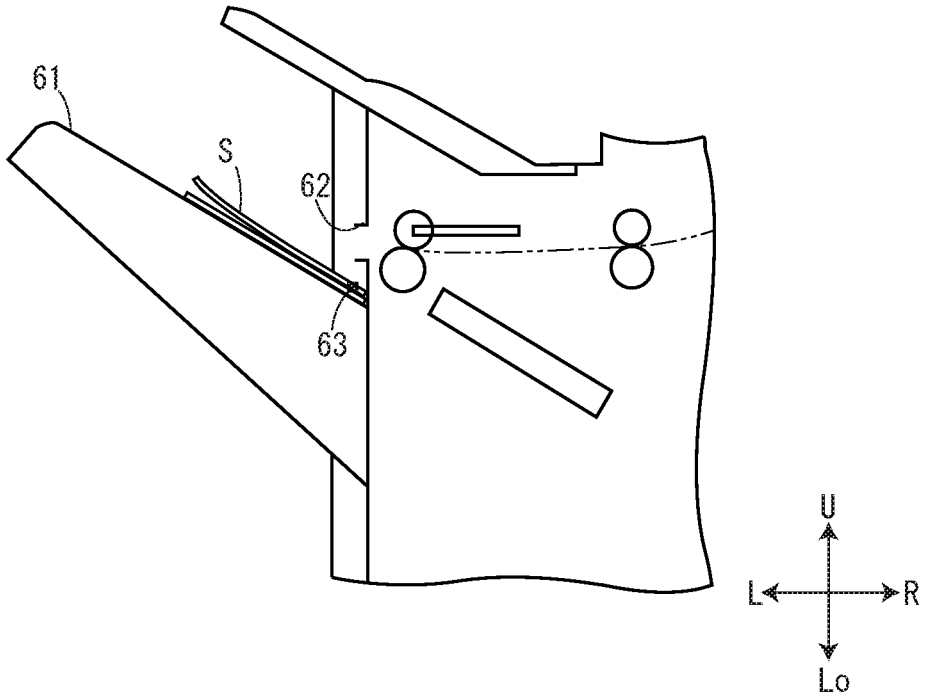
FIG. 3A is a view showing a sheet stacking operation according to one example of a comparative embodiment.

However, as shown in a comparative example shown in FIG. 3A, the sheet S may curl owing to drying of the toner or the ink transferred on one surface of the sheet S. In particular, when the image is printed on the sheet S by inkjet printing, the sheet S easily curls. Then, although the upper surface detection part 63 near the discharge port 62 of the lower discharge tray 61 detects the upstream side upper surface of the sheet S, it does not detect the downstream side upper surface of the sheet S whose height is higher than the upstream side upper surface of the sheet S. As a result, regardless of the curl of the sheet S, a height of the lower discharge tray 61 is adjusted based on a height of the upstream side upper surface of the sheet S.

Figure 3B:
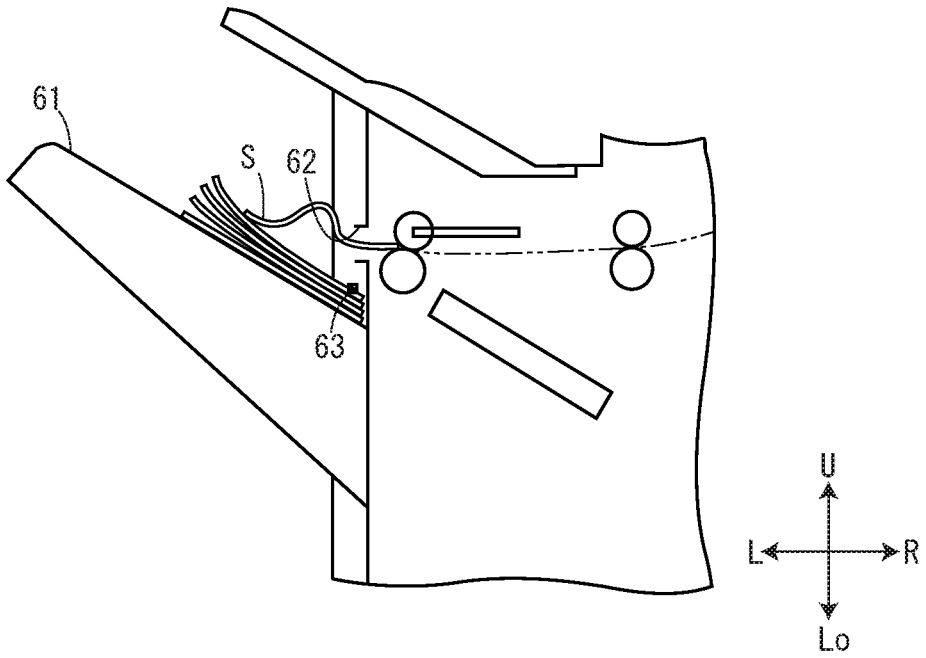
FIG. 3B is a view showing a sheet stacking operation according to the example of the comparative embodiment.

As shown in FIG. 3B, when the sheet S is continuously stacked on the lower discharge tray 61, an inclined angle of the downstream side upper surface of the sheets S on the lower discharge tray 61 becomes large. Then, the next sheet S discharged through the discharge port 62 touches on the downstream side of the sheets S previously stacked on the lower discharge tray 61, and a sheet jamming may occur. Even if the sheet jamming does not occur, the smooth discharging of the next sheet S through the discharge port 62 is prevented by the downstream side of the sheets S stacked on the lower discharge tray 61, and aligning performance of the sheets S stacked on the lower discharge tray 61 deteriorates.

Figure 4:
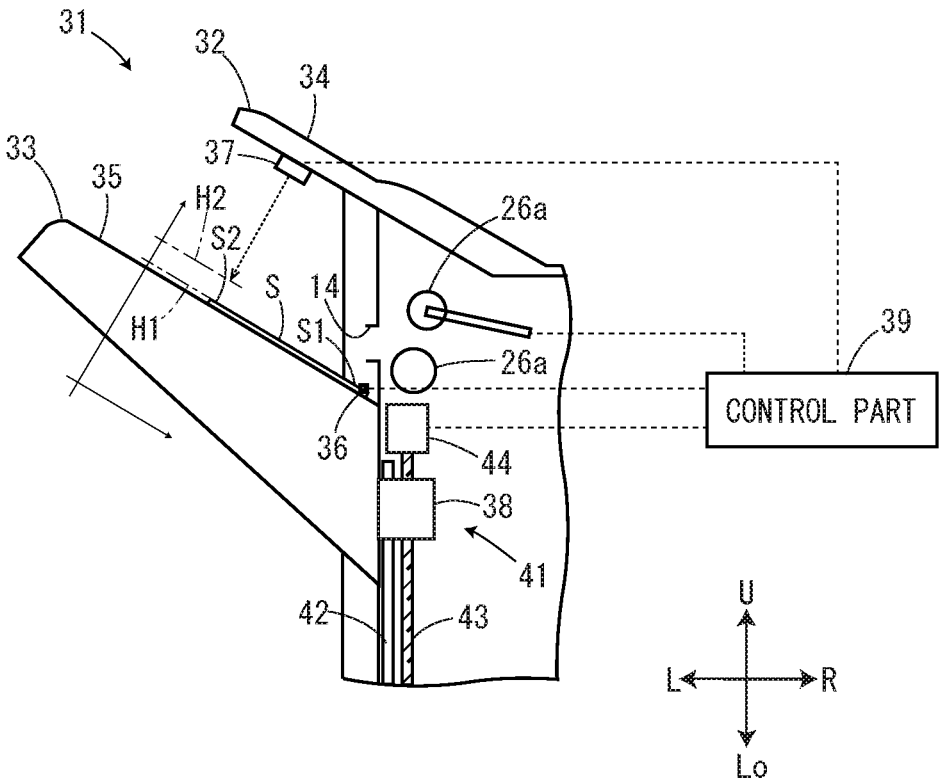
FIG. 4 is a view schematically showing a sheet stacking device according to the present embodiment.

Then, the sheet stacking device 31 according to the present embodiment includes a first upper surface detection part 36 detecting a first detected surface S1 of the upstream side upper surface of the sheet S and a second upper surface detection part 37 detecting a second detected surface S2 of the downstream side upper surface of the sheet S (refer to FIG. 4). By detecting the first and second detected surfaces S1 and S2 by the first and second upper surface detection parts 36 and 37 respectively, a deformation of the sheet S stacked on the lower discharge tray 33 is recognized. Then, a height of the lower discharge tray 33 is adjusted in view of a degree of the deformation of the sheet S so that the sheet jamming and the deteriorating of the aligning performance of the sheets S are reduced at the discharging of the sheet S.

Hereinafter, with reference to FIG. 4, a configuration of the sheet stacking device will be described in detail. FIG. 4 is a view schematically showing the sheet stacking device according to the present embodiment. The sheet stacking device shown in FIG. 4 has a configuration generally provided in a conventional sheet stacking device, and the description of the configuration is omitted. The reference numbers marked in FIG. 2 are suitably used.

As shown in FIG. 4, the sheet stacking device 31 includes the lower discharge tray 33 on which the sheet S discharged through the lower discharge port 14 is stacked and the upper discharge tray 32 on which the sheet S discharged through the upper discharge port 13 is stacked. A placement surface of the lower discharge tray 33 is inclined upward from the left side surface of the housing 11 outward. The base end of the placement surface 35 is positioned below the lower discharge port 14 so as not to interfere with the sheet S discharged through the lower discharge port 14. A placement surface 34 of the upper discharge tray 32 is inclined in approximately parallel with the placement surface 35 of the lower discharge tray 33. The base end of the placement surface 34 is positioned below the upper discharge port 13 so as not to interfere with the discharging of the sheet S.

On the housing wall surface on the base end side of the lower discharge tray 33, the first upper surface detection part 36 is provided below the lower discharge port 14. The first upper surface detection part 36 is capable of detecting the first detected surface S1 of the upstream side upper surface of the sheet S stacked on the lower discharge tray 33. On the tip end side lower surface of the upper discharge tray 32, the second upper surface detection part 37 is provided. The second upper surface detection part 37 is capable of detecting the second detected surface S2 of the downstream side upper surface of the sheet S stacked on the lower discharge tray 33. The first upper surface detection part 36 is a transmission type photosensor (photo interrupter) in which a light emitting element and a light receiving element are disposed to face each other in the sheet width direction, and the presence or absence of an object is detected by shielding light when an object to be detected passes between them. The second upper surface detection part 37 is a reflection type photosensor (photo reflector) in which a light emitting element and a light receiving element are disposed on the same plane, and the presence or absence of an object is detected by the reflected light of an object to be detected.

The light emitting element and the light receiving element of the first upper surface detection part 36 is set at a first height H1 on the housing wall surface. A detection light emitted from the light emitting element to the light receiving element is shielded by the sheets S or the discharge tray 33 disposed at first height H1 or higher, and the upper surface of the uppermost sheet S or the lower discharge tray 33 is thus detected. A detection range of the light emitting element and the light receiving element of the second upper surface detection part 37 is set to be at a second height higher than the first height H1 or higher in the sheet stacking direction. A detection light emitted from the light emitting element to the placement surface 35 is reflected on the upper surface of the uppermost sheet S of the sheets S stacked on the placement surface 35 at the second height or higher, received by the light receiving element, and the upper surface of the uppermost sheet S is thus detected. As described above, a second detectable position of the second upper surface detection part 37 is higher than a first detectable position of the first upper surface detection part 36. A distance between the second detectable position and the upper surface of the lower discharge tray 33 is longer than a distance between the first detectable position and the upper surface of the lower discharge tray 33.

In the above manner, the first detected surface S1 of the uppermost sheet S having the first height H1 or higher is detected by the first upper surface detection part 36, and the second detected surface S2 of the uppermost sheet S having the second height H2 or higher, which is higher than the first height H1, is detected by the second upper surface detection part 37. As a result, it becomes possible to recognize the deformation of the sheet S whose downstream side is higher than the upstream side. The first and second upper surface detection parts 36 and 37 are connected to the control part 39, and an ON signal or an OFF signal as a detection result of the upper surface of the uppermost sheet S is output from the first and second upper surface detection parts 36 and 37 to the control part 39. The first height H1 and the second height H2 are set to be lower than the lower discharge port 14.

In the housing 11, a lifting mechanism 41 which supports the lower discharge tray 33 so as to be lifted and lowered is provided. The lifting mechanism 41 includes a vertically long guide rail 42 provided on the wall surface of the housing 11 and a feed screw 43 provided on the wall surface of the housing 11 in parallel with the guide rail 42. A coupling part 38 provided in the base end side of the lower discharge tray 33 is engaged with the guide rail 42 so as to be slid along the guide rail 42 and is meshed with the feed screw 43. When a drive motor 44 connected to one end of the feed screw 43 is driven, the lower discharge tray 33 is lifted and lowered along the guide rail 42.

The drive motor 44 is connected to the control part 39, and the control part 39 controls the lifting operation of the lower discharge tray 33. The control part 39 controls the drive motor 44 to lift and lower the lower discharge tray 33 based on the detection results of the first and second upper surface detection parts 36 and 37 such that the uppermost sheet S on the lower discharge tray 33 is kept at a constant height. In this case, a detection operation to lower the lower discharge tray 33 down to outside the detection range once, to lift it and then to detect the first detected surface S1 or the second detected surface S2 is performed by the control part 39 at a suitable timing. Depending on whether the second upper surface detection part 37 detects the second detected surface S2 of the uppermost sheet S, the lifting control of the lower discharge tray 33 using the detection result of the first upper surface detection part 36 and the lifting control of the lower discharge tray 33 using the detection result of the second upper surface detection part 37 are switched.

At a time when the first upper surface detection part 36 detects the first detected surface S1, when the second upper surface detection part 37 does not yet detect the second detected surface S2 of the uppermost sheet S, it is recognized by the control part 39 that the sheets S on the lower discharge tray 33 are not deformed. In this case, based on the detection result of the first upper surface detection part 36, the lower discharge tray 33 is lifted or lowered such that a height of the first detected surface S1 of the upstream side upper surface of the uppermost sheet S becomes the first height H1. In a state where the first upper surface detection part 36 does not yet detect the first detected surface S1, when the second upper surface detection part 37 detects the second detected surface S2 of the sheet S, it is recognized by the control part 39 that the downstream side upper surface of the sheet S on the lower discharge tray 33 is higher than the upstream side upper surface. In this case, based on the detection result of the second upper surface detection part 37, the lower discharge tray 33 is lifted or lowered such that a height of the second detected surface S2 of the downstream side upper surface of the uppermost sheet S becomes the second height H2.

Figure 7:
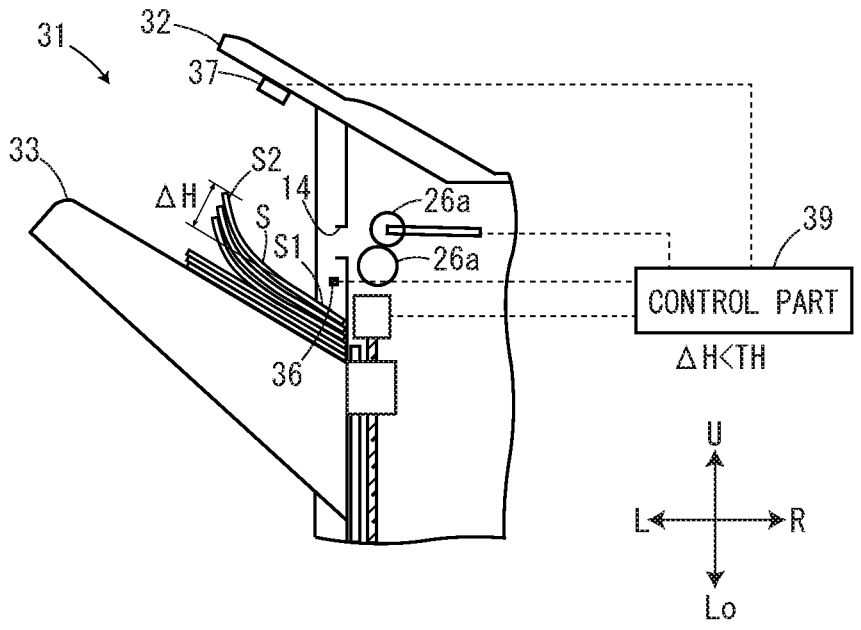
FIG. 7 is a view showing a stopping operation of a discharge roller, in the sheet stacking device according to the present embodiment.

Furthermore, when the sheet S is stacked on the lower discharge tray 33 in a deformed state, a degree of the deformation of the uppermost sheet S becomes large as the sheet S is stacked (refer to FIG. 7). Then, in a case where a difference in height between the first detected surface S1 and the second detected surface S2 of the uppermost sheet S is larger than a predetermined value, the control part 39 stops the discharging operation of the sheet S to the lower discharge tray 33 by the discharge rollers 26*a* and 26*b*, and the stacking failure of the sheet S is reported to a user. Accordingly, when the deformation of the sheet S on the lower discharge tray 33 is large, the discharging operation is stopped before the next sheet S is discharged to the lower discharge tray 33, and the sheet jamming can be thus prevented.

Figure 5A:
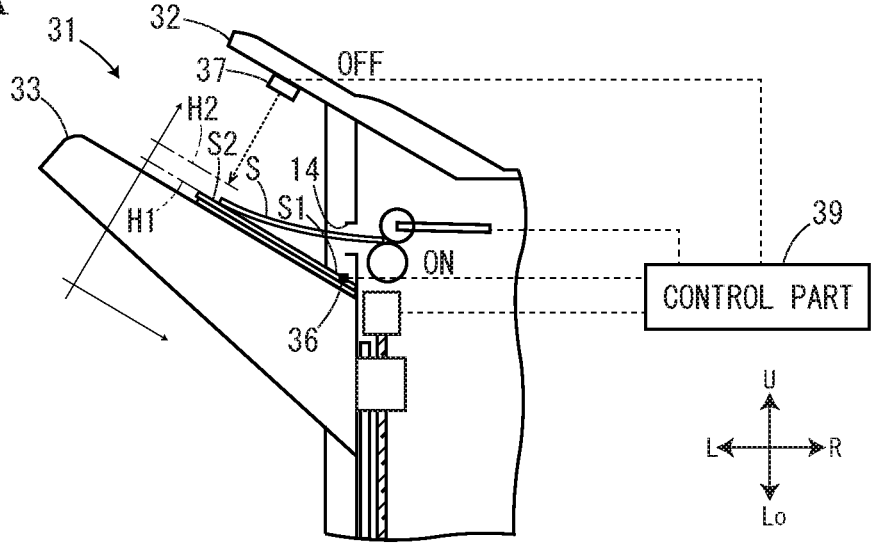
FIG. 5A is a view showing an example of a sheet stacking operation for undeformed sheets, in the sheet stacking device according to the present embodiment.
Figure 5B:
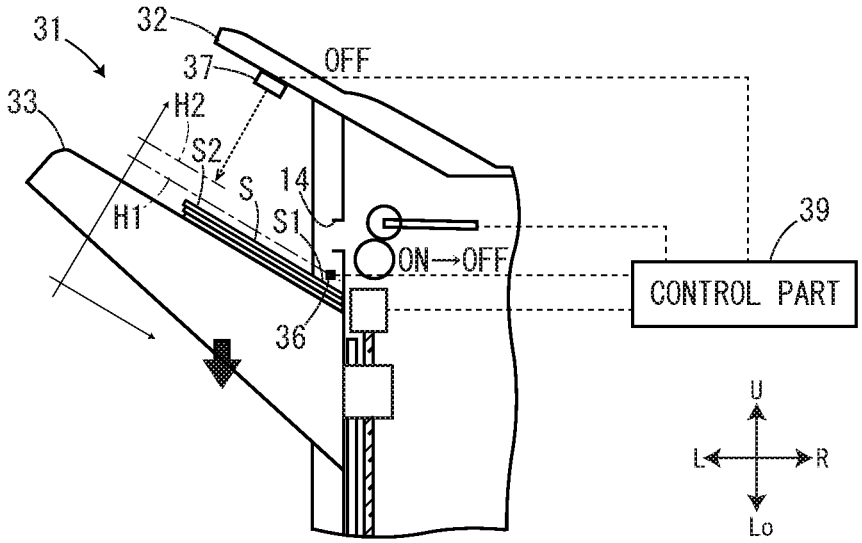
FIG. 5B is a view showing the example of the sheet stacking operation for undeformed sheets, in the sheet stacking device according to the present embodiment.
Figure 5C:
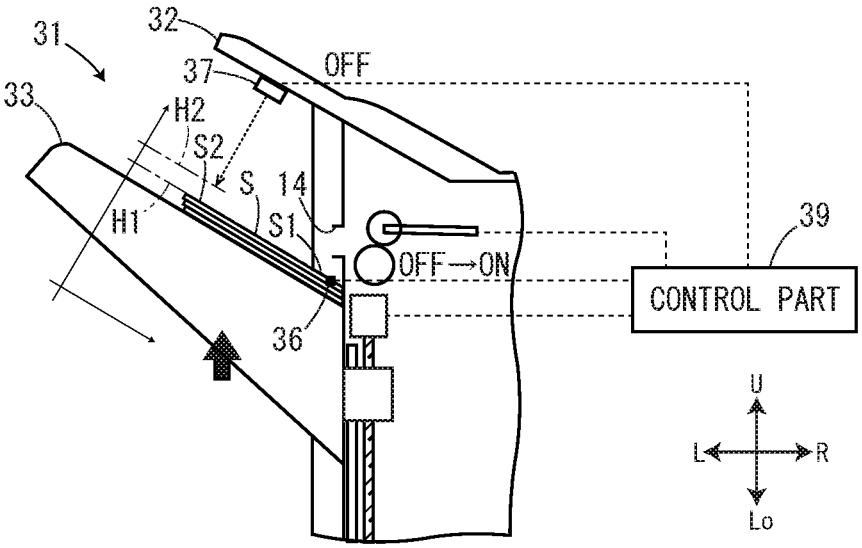
FIG. 5C is a view showing the example of the sheet stacking operation for undeformed sheets, in the sheet stacking device according to the present embodiment.
Figure 6A:
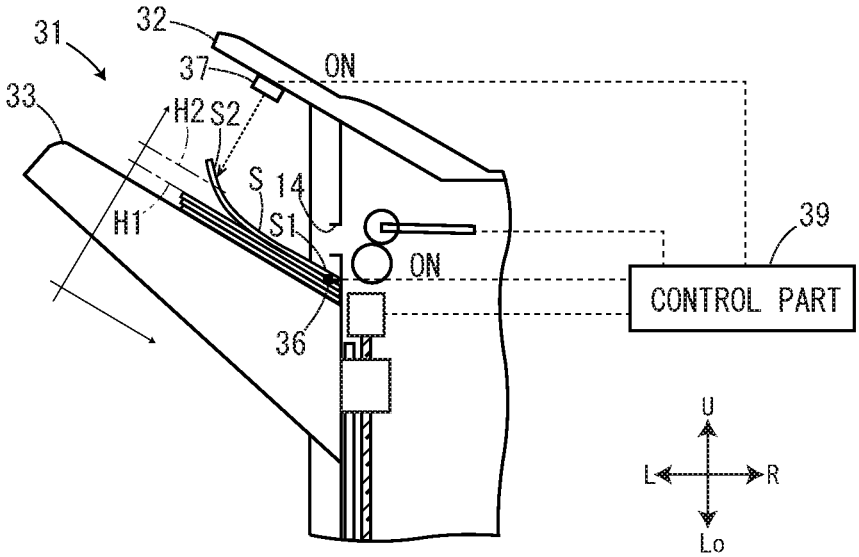
FIG. 6A is a view showing an example of a sheet stacking operation for deformed sheets, in the sheet stacking device according to the present embodiment.
Figure 6B:
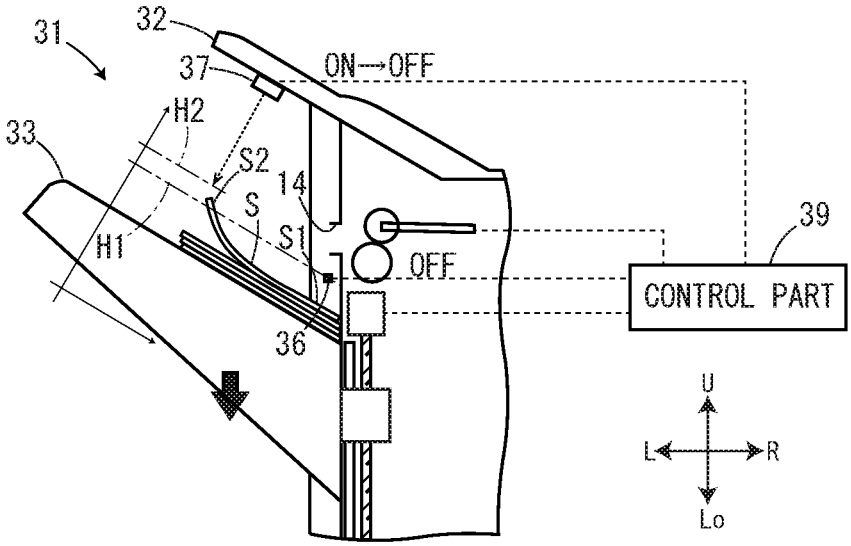
FIG. 6B is a view showing the example of the sheet stacking operation for deformed sheets, in the sheet stacking device according to the present embodiment.
Figure 6C:
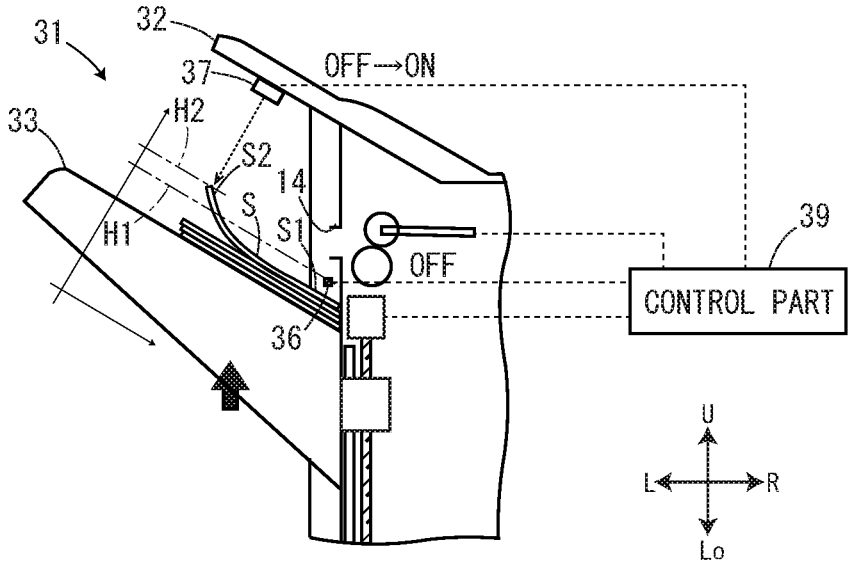
FIG. 6C is a view showing the example of the sheet stacking operation for undeformed sheets, in the sheet stacking device according to the present embodiment.

Next, with reference to FIG. 5A to FIG. 7, a stacking operation of the sheet stacking device will be described. FIGS. 5A to 5C are views showing an example of the sheet stacking operation for undeformed sheets, in the sheet stacking device of the present embodiment. FIGS. 6A to 6C are views showing an example of the sheet stacking operation for deformed sheet, in the sheet stacking device of the present embodiment. FIG. 7 is a view showing a stopping operation of the discharge rollers in the sheet stacking device of the present embodiment. Here, the same reference numbers as the reference numbers in FIG. 2 are suitably used.

As shown in FIG. 5A, in an initial state, the upper surface of the uppermost sheet S on the lower discharge tray 33 is adjusted at the first height H1. Because the sheet S is not deformed, a height of the first detected surface S1 of the uppermost sheet S is the same as the first height H1, and a height of the second detected surface S2 of the uppermost sheet S is lower than the second height H2. Then, the first upper surface detection part 36 detects the first detected surface S1 of the uppermost sheet S and is switched in an ON state. The second upper surface detection part 37 does not detect the second detected surface S2 of the uppermost sheet S and is switched in an OFF state. Because the second upper surface detection part 37 is in the OFF state, the control part 39 controls the lifting operation of the lower discharge tray 33 based on the detection result of the first upper surface detection part 36.

As shown in FIG. 5B, as next sheet S is stacked on the lower discharge tray 33, the lower discharge tray 33 is controlled by the control part 39 to be lowered until the first upper surface detection part 36 is switched from the ON state to the OFF state. As a result, the first detected surface S1 of the uppermost sheet S on the lower discharge tray 33 is lowered than the first height H1. Next, as shown in FIG. 5C, the lower discharge tray 33 is controlled by the control part 39 to be lifted until the first upper surface detection part 36 is switched from the OFF state to the ON state. As a result, a height of the first detected surface S1 of the uppermost sheet S on the lower discharge tray 33 is adjusted to the first height H1. By repeating the above lifting operation, the upper surface of the uppermost sheet S is kept at the first height H1.

As shown in FIG. 6A, when the next sheet S curled into a concave shape in a side view is stacked on the lower discharge tray 33, the second detected surface S2 of the uppermost sheet S on the lower discharge tray 33 is higher than the first detected surface S1. When the second detected surface S2 of the uppermost sheet S is higher than the second height H2, the second upper surface detection part 37 detects the second detected surface S2 of the uppermost sheet S and is switched in the ON state. Because the second upper surface detection part 37 is in the ON state, the control part 39 controls the lifting operation of the lower discharge tray 33 based on the detection result of the second upper surface detection part 37. In the above manner, it is switched from the lifting control based on the detection result of the first upper surface detection part 36 to the lifting control based on the detection result of the second upper surface detection part 37.

As shown in FIG. 6B, when the second upper surface detection part 37 is switched in the ON state, the lower discharge tray 33 is controlled by the control part 39 to be lowered until the second upper surface detection part 37 is switched from the ON state to the OFF state. As a result, the second detected surface S2 of the uppermost sheet S on the lower discharge tray 33 is lowered than the second height H2. Next, as shown in FIG. 6C, the lower discharge tray 33 is controlled by the control part 39 to be lifted until the second upper surface detection part 37 is switched from the OFF state to the ON state. As a result, the second detected surface S2 of the uppermost sheet S on the lower discharge tray 33 is adjusted at the second height H2. By repeating the above lifting operation, the upper surface of the uppermost sheet S is kept at the second height H2.

As shown in FIG. 7, as the curled sheet S is continuously stacked on the lower discharge tray 33, a difference ΔH in height between the first detected surface S1 and the second detected surface S2 of the uppermost sheet S on the lower discharge tray 33 is larger than the predetermined value TH. When the difference ΔH is larger than the predetermined TH, the control part 39 stops the discharge operation of the discharge rollers 26*a* and 26*b*. A calculation way of the difference ΔH in height between the first detected surface S1 and the second detected surface S2 of the uppermost sheet S is not limited. For example, it may be calculated based on a time period from a time when the lower discharge tray 33 is lifted from the outside the detection range of the first and second upper surface detection parts 36 and 37 and then the second upper surface detection part 37 is switched into the ON state to a time when the first upper surface detection part 36 is switched into the ON state or from a time when the lower discharge tray 33 is lifted from the outside the detection range of the first and second upper surface detection parts 36 and 37 and then the first upper surface detection part 36 is switched into the ON state to a time when the second upper surface detection part 37 is switched into the ON state. Alternatively, it may be estimated based on a number of the sheets S detected by the second upper surface detection part 37. As the predetermined value TH, a value obtained experimentally, empirically or logically from the past data or the type of the sheet is used.

As described above, according to the present embodiment, the first and second upper surface detection parts 36 and 37 respectively detect the first and second detected surfaces S1 and S2 of the uppermost sheet S, and the deformation of the sheet S stacked on the lower discharge tray 33 is recognized based on the detection results. Then, the lower discharge tray 33 is lifted or lowered depending on the deformation of the sheet S, so that the aligning performance of the sheets S stacked on the lower discharge tray 33 is improved and the occurrence of the sheet jamming at the discharging of the sheet S is prevented.

Figure 8:
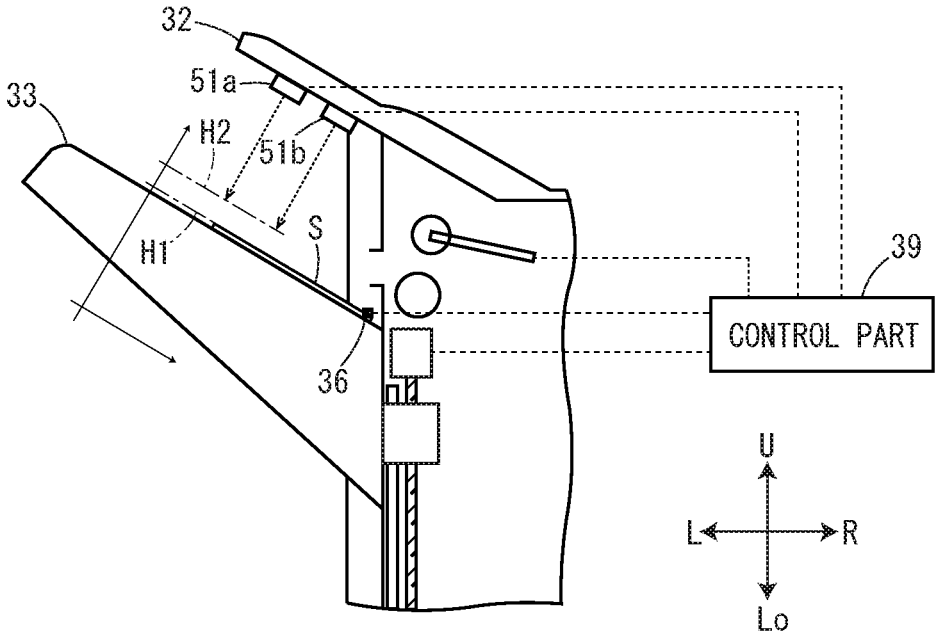
FIG. 8 is a view schematically showing the sheet stacking device according to a first modified example of the present embodiment.

The present embodiment has a configuration such that the second upper surface detection part 37 is provided so as to correspond to the portrait sheet S. The present embodiment is not limited to the above configuration. For example, as shown in FIG. 8, a plurality of the second upper surface detection parts 51*a* and 51*b* may be provided so as to correspond to the portrait sheet S and the landscape sheet S. Then, it becomes possible to lift or lower the lower discharge tray 33 in view of the deformation of the landscape sheet S. Further, a plurality of the second upper surface detection parts 51*a* and 51*b* may be provided in accordance with the sheet size. By providing a plurality of the second upper surface detection parts 51*a* and 51*b*, it may become possible to recognize the convex deformation of the sheet S on the discharge tray.

Figure 9:
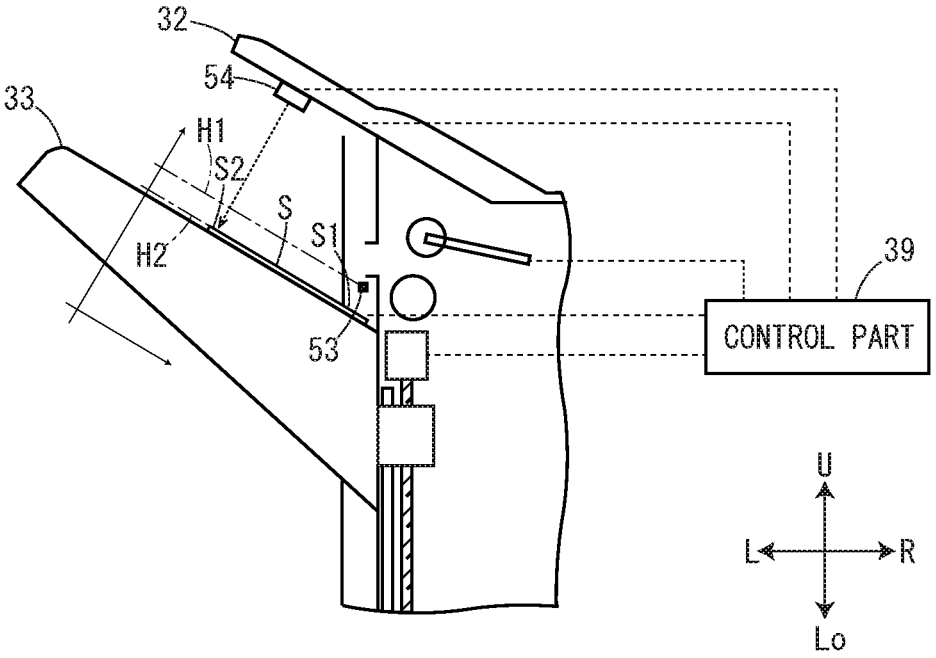
FIG. 9 is a view schematically showing the sheet stacking device according to a second modified example of the present embodiment.

The present embodiment has a configuration such that the second height H2 for the second upper surface detection part 37 is set to be higher than the first height H1 for the first upper surface detection part 36. However, the present embodiment is not limited to the above configuration. As shown in FIG. 9, the first height H1 may be set to be higher than the second height H2. In this case, when the first upper surface detection part 53 does not detect the first detected surface S1 of the uppermost sheet S, the lower discharge tray 33 is lifted or lowered based on the detection result of the second upper surface detection part 54. When the first upper surface detection part 53 detects the first detection surface S1 of the uppermost sheet S, the lower discharge tray 33 is lifted or lowered based on the detection result of the first upper surface detection part 53.

Figure 10:
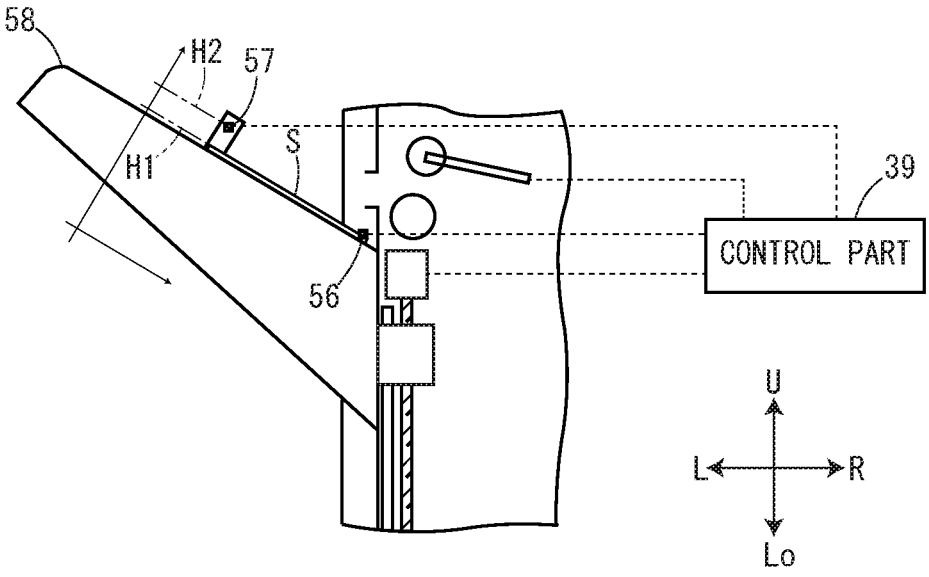
FIG. 10 is a view schematically showing the sheet stacking device according to a third modified example of the present embodiment.

The present embodiment has a configuration such that the transmission type photosensor is provided as the first upper surface detection part 36 near the lower discharge port 14 of the lower discharge tray 33 and the reflection type photosensor is provided as the second upper surface detection part 37 on the lower surface of the upper discharge tray 32. However, the present embodiment is not limited to the above configuration. For example, as shown in FIG. 10, two transmission type photosensors are provided as the first and second upper surface detection parts 56 and 57 in the single discharge tray 58.

The present embodiment has a configuration such that the post processing apparatus 2 includes the punching device 21 and the stapler 28 as the post processing part. However, the present embodiment is not limited to the above configuration. The post processing part may be performable the post processing on the sheet S, and may be a folding device which folds the sheet S, for example.

The present embodiment has a configuration such that the sheet stacking device 31 is provided in the post processing apparatus 2. However, the present embodiment is not limited to the above configuration. The sheet stacking device 31 may be provided in the image forming apparatus.

The present embodiment has a configuration such that the first upper surface detection part 36 is a photosensor which detects the first detected surface S1 of the uppermost sheet S at the first height H1. However, the present embodiment is not limited to the above configuration. The first upper surface detection part 36 may be detectable the first detected surface S1 of the uppermost sheet S on the lower discharge tray 33, and may be a displacement sensor detectable the height of the first detected surface S1 of the uppermost sheet S, for example.

The present embodiment has a configuration such that the second upper surface detection part 37 is a photosensor which detects the second detected surface S2 of the uppermost sheet S at the second height H2. However, the present embodiment is not limited to the above configuration. The second upper surface detection part 37 may be detectable the second detected surface S2 of the uppermost sheet S on the lower discharge tray 33, and may be a displacement sensor detectable the height of the second detected surface S2 of the sheet S, for example.

In the present embodiment, the multifunctional peripheral 1 having a printing function, a copying function, a facsimile function and the other function is shown as an example of the image forming apparatus. However, the image forming apparatus may be a printer, a copying machine and a facsimile.

In the present embodiment, the sheet S may be a sheet-shaped one on which the image is to be formed, for example, include a plain paper, a coated paper, a tracing paper, an over head projector (OHP) sheet.

The present embodiment has been described above. However, as other embodiments, the above embodiment and the modified example may be combined totally or partially.

Furthermore, the techniques of the present disclosure are not limited to the above described embodiment, and may be modified, substituted or changed in various ways without departing from the spirit of the technical idea. Furthermore, if a technical idea can be realized in another way by development of technology or another derived technology, it may be performed using the technique. Accordingly, the claims cover all embodiment that may contained in the scope of the technical idea.

While the present disclosure has been described for specific embodiments, the present disclosure is not limited to the above embodiments. Those skilled in the art can modify the above embodiment without departing from the scope and sprit of the present disclosure.

The invention claimed is:

1. A sheet stacking device comprising:

a housing having a discharge port from which a sheet is discharged;

a discharge tray on which the sheet discharged from the discharge port in a predetermined discharge direction is stacked;

a lifting mechanism provided in the housing to support the discharge tray so as to be lifted and lowered;

a first upper surface detection part detecting a first detected surface of an upper surface of the sheet on the discharge tray on an upstream side in the sheet discharge direction;

a second upper surface detection part detecting a second detected surface of the upper surface of the sheet on the discharge tray on a downstream side of the first detected surface in the sheet discharge direction; and a control part which controls the lifting mechanism based on a detection result of the first upper surface detection part and a detection result of the second upper surface detection part and adjusts the discharge tray at a predetermined height.

2. The sheet stacking device according to claim 1, wherein a second detectable position of the second upper surface detection part is higher than a first detectable position of the first upper surface detection part, and a distance between the second detectable position and an upper surface of the discharge tray is longer than a distance between the first detectable position and the upper surface of the discharge tray.

3. The sheet stacking device according to claim 2, wherein the control part performs a detection operation for detecting the first detected surface or the second detected surface in a manner of lowering the discharge tray down to outside a detection range of the first upper surface detection part and the second upper surface detection part once and then lifting it, at a suitable timing, in the detection operation, when the second upper surface detection part does not detect the second detected surface while the first upper surface detection part detects the first detected surface, the control part controls the lifting mechanism to lift or lower the discharge tray based on the detection result of the first upper surface detection part and to adjust the discharge tray at a predetermined height, and when the second upper surface detection part detects the second detected surface while the first upper surface detection part does not detect the first detected surface, the control part controls the lifting mechanism to lift or lower the discharge tray based on the detection result of the second upper surface detection part and to adjust the discharge tray at a predetermined height.

4. The sheet stacking device according to claim 1, wherein the sheet is discharged on the discharge tray through the discharge port by a discharge part, and when a difference in height between the first detected surface and the second detected surface is larger than a predetermined value, the control part controls the discharge part to stop discharging operation of the sheet on the discharge tray.

5. The sheet stacking device according to claim 4, wherein the difference in height between the first detected surface and the second detected surface is calculated based on a time from when the discharge tray is lifted from outside a detection range of the first and second upper surface detection parts and then the second upper surface detection part detects the second detected surface to when the first upper surface detection part detects the first detected surface or a time from when the discharge tray is lifted from the outside the detection range and then the first upper surface detection part detects the first detected surface to when the second upper surface detection part detects the second detected surface.

6. The sheet stacking device according to claim 1, wherein the housing has a wall surface, an upper discharge tray on which the sheet is stacked is supported by the housing above the lower discharge tray, the first upper surface detection part is provided below the discharge port of the wall surface, and the second upper surface detection part is provided on a lower surface of the upper discharge tray so as to face the second detected surface.

7. The sheet stacking device according to claim 6, wherein the second upper surface detection part includes a plurality of second upper surface detection parts, and the plurality of second upper surface detection parts are provided along the sheet discharge direction on the lower surface of the upper discharge tray so as to correspond to the sheet size.

8. A post processing apparatus comprising:

the sheet stacking device according to claim 1; and a post processing part performing a post processing on the sheets and discharging the sheets to the sheet stacking device.

9. An image forming apparatus comprising:

an image forming part forming an image on the sheet; and the post processing apparatus according to claim 8.

* * * * *